US006699163B2

(12) United States Patent
Gallagher

(10) Patent No.: US 6,699,163 B2
(45) Date of Patent: Mar. 2, 2004

(54) STRETCHING CENTER

(76) Inventor: James Gallagher, 4018 Mansion Dr., Washington, DC (US) 20007

( * ) Notice: Subject to any disclaimer, the term of this patent is extended or adjusted under 35 U.S.C. 154(b) by 149 days.

(21) Appl. No.: 09/978,069

(22) Filed: Oct. 17, 2001

(65) Prior Publication Data

US 2003/0073551 A1 Apr. 17, 2003

(51) Int. Cl.[7] ..... A63B 26/00

(52) U.S. Cl. ..... 482/142; 482/52; 482/14; 482/15; 482/35; 482/907

(58) Field of Search ..... 482/14, 15, 52, 482/35, 36–38, 107, 142, 148, 907; 473/266, 150, 157, 160

(56) References Cited

U.S. PATENT DOCUMENTS

| | | | | | |
|---|---|---|---|---|---|
| 3,035,671 | A | * | 5/1962 | Sicherman | 189/43 |
| 4,506,884 | A | | 3/1985 | Hankin | |
| 5,209,711 | A | | 5/1993 | Scrima | |
| 5,529,560 | A | | 6/1996 | Davies et al. | |
| 5,842,960 | A | | 12/1998 | Yu | |
| 5,913,755 | A | | 6/1999 | Chung | |
| 6,019,740 | A | | 2/2000 | Hausman | |
| 6,063,007 | A | * | 5/2000 | Sithole | 485/52 |
| 6,174,270 | B1 | | 1/2001 | Dagenais | |
| 6,228,005 | B1 | | 5/2001 | Gray | |

* cited by examiner

*Primary Examiner*—Nicholas D. Lucchesi
*Assistant Examiner*—L Amerson
(74) *Attorney, Agent, or Firm*—Rabin & Berdo, P.C.

(57) ABSTRACT

A stretching apparatus for use on a golf course provides a wall with a top ridge, a reclined plane and a curb platform, each capable of supporting all or part of a human body. The top ridge may have at its opposite ends, multiple horizontal levels of differing heights. The wall has an obverse surface against which the reclined plane is disposed, and a reverse surface against which the curb platform is disposed. The stretching center may have stilts that elevate the reclined plane above the ground. The preferred embodiment of the stretching center includes a balancing handhold at a centered portion of the wall midway between it opposite ends, extending higher than the multiple levels of the top ridge, for providing balancing support to persons performing stretching exercises on the wall or the curb platform.

24 Claims, 4 Drawing Sheets

STRETCHING CENTER

BACKGROUND OF THE INVENTION

1. Field of the Invention

The present invention relates to a bench to facilitate stretching exercises for golfers. More particularly, the present invention relates to a bench available to golfers on a golf course for stretching muscles in the legs and lower torso.

2. Background

Golf is a sport that can be played by persons of various ages and levels of physical fitness. In golf, the upper body and torso muscles are engaged less extensively than in other sports. Between intervals wherein a golfer may swing a club with which to strike a golf ball on its intended path, exertion may tighten muscles in the lower back, hamstrings, quadriceps, calves and gluteus. Such exercise may derive from walking distances, ascending and descending hills, negotiating hazards, and bending over a golf-tee. Muscle tightening may even occur from mounting, riding and dismounting a golf-cart.

Stiffness from lower body muscle tightening may lead to discomfort, fatigue, reduced flexibility for swinging the club, and possibly lead to injury. In order to prevent such consequences, the muscles of the lower body should be stretched throughout the entire round of golf. While devices for strengthening the upper torso and arms have been marketed for a considerable period of time, these devices may lack the means for proper stretching of lower body muscles and further be inaccessible during a game of golf.

Accordingly, there exists a need for an efficient, simple and inexpensive method for providing lower body muscle stretching on a golf course.

SUMMARY OF THE INVENTION

A stretching center for use on the golf course provides a wall with a ledge at its top end, a reclined plane at its front side, and a curb platform, each capable of supporting a human body. The wall has an obverse side against which the reclined plane, in the form of a bench, for example, is disposed for use by the golfer for stretching in a reclined position. The curb platform is provided, for example, against the reverse side of the wall, for use in stretching the calf muscles. The wall also has a top ridge having one or more levels for use in stretching the quadriceps and hamstrings. The stretcher may include a handle at the rear of the wall to aid the golfer in maintaining balance during the calf, quadriceps and hamstring stretches.

BRIEF DESCRIPTION OF THE DRAWINGS

The accompanying drawings, which are incorporated into and constitute a part of the specification, illustrate one or more embodiments of the present invention and, together with the detailed description, serve to explain the principles and implementations of the invention.

In the drawings.

DETAILED DESCRIPTION OF THE PREFERRED EMBODIMENT

Figure 1:
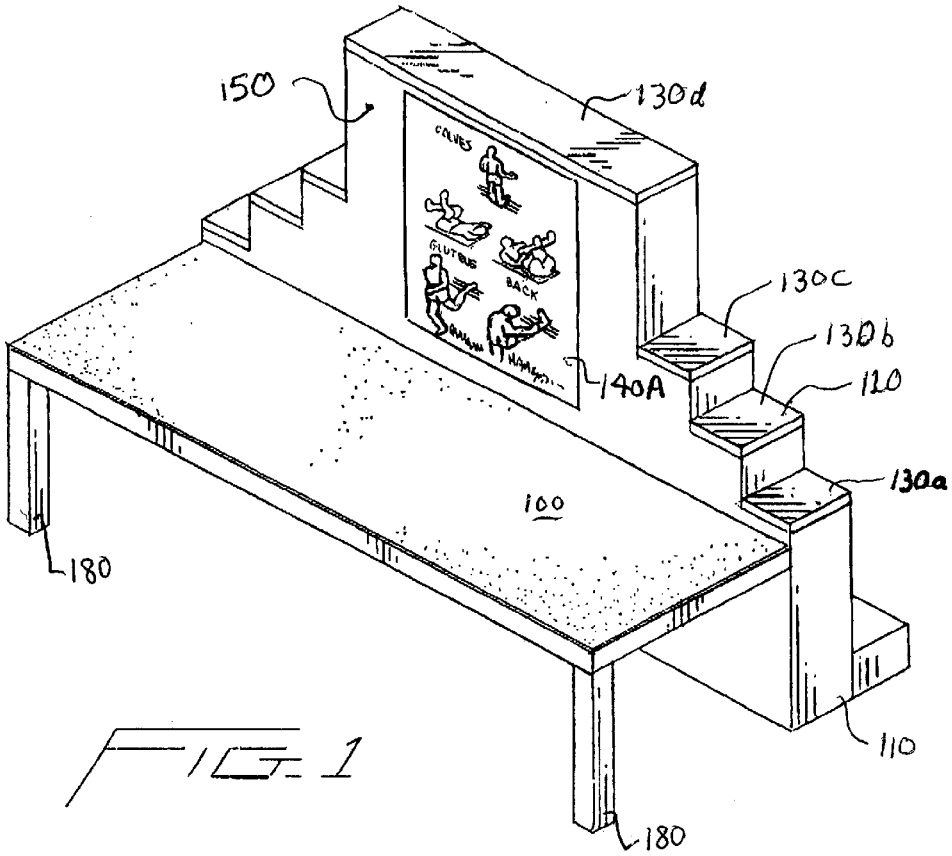
FIG. 1 is an isometric front-view illustration of a golf stretching center in accordance with a presently preferred embodiment of the invention.

Embodiments of the present invention are described herein in the context of a stretching center particularly adapted for golfers while on a golf course. Those of ordinary skill in the art will realize that the following description of the invention is illustrative only and not in any way limiting. Other embodiments of the invention will readily suggest themselves to such skilled persons having the benefit of this disclosure. Reference will now be made in detail to implementations of the present invention as illustrated in the accompanying drawings. The same reference indicators will be used throughout the drawings and the following detailed description to refer to the same or like parts.

In the interest of clarity, not all of the routine figures of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

A stretching center in accordance with a presently preferred embodiment of the present invention includes a wall having top ridge, particularly in a form having one or more, preferably six, horizontally extending levels, most preferably two identical sets of three differing height levels on opposite sides of a centrally located top-most horizontally-extending ridge. A bench-like member with a reclined plane abutting an obverse (front) surface of the wall, is supported so that the reclined plane is set at a suitable height, as by a pair of stilts supporting the front edge of the bench. A curb platform is provided on a reverse (rear) surface of the wall. A handle is provided centrally on the back of the wall below the uppermost ridge, to aid a user to balance himself or herself when stretching at the rear of the wall. Optionally, also for balance, posts or rails may extend vertically from opposite ends of the wall, and the one centrally located handle may be replaced by handles on the posts extending for example, four inches, towards the rear. The posts or rails or handles may be provided in addition to or in place of the centrally located handle of the preferred embodiment. Another option is to replace the top-most horizontal ridge by an arc-shaped ridge to provide a balancing means for users of different height.

The stretching center may be weighted to inhibit unauthorized relocation or composed from a heavy but inexpensive and durable metal (e.g., steel). Alternatively, the stretcher bench may be constructed of corrosion-resistant low-density high-strength-to-weight materials (e.g., aluminum, graphite) to facilitate authorized relocation to facilitate scheduled lawn maintenance. Yet alternatively, the stretcher bench may be constructed from inexpensive commercially available construction materials (e.g., wood, plastic) that can be used for fabrication by carpentry.

Figure 3:
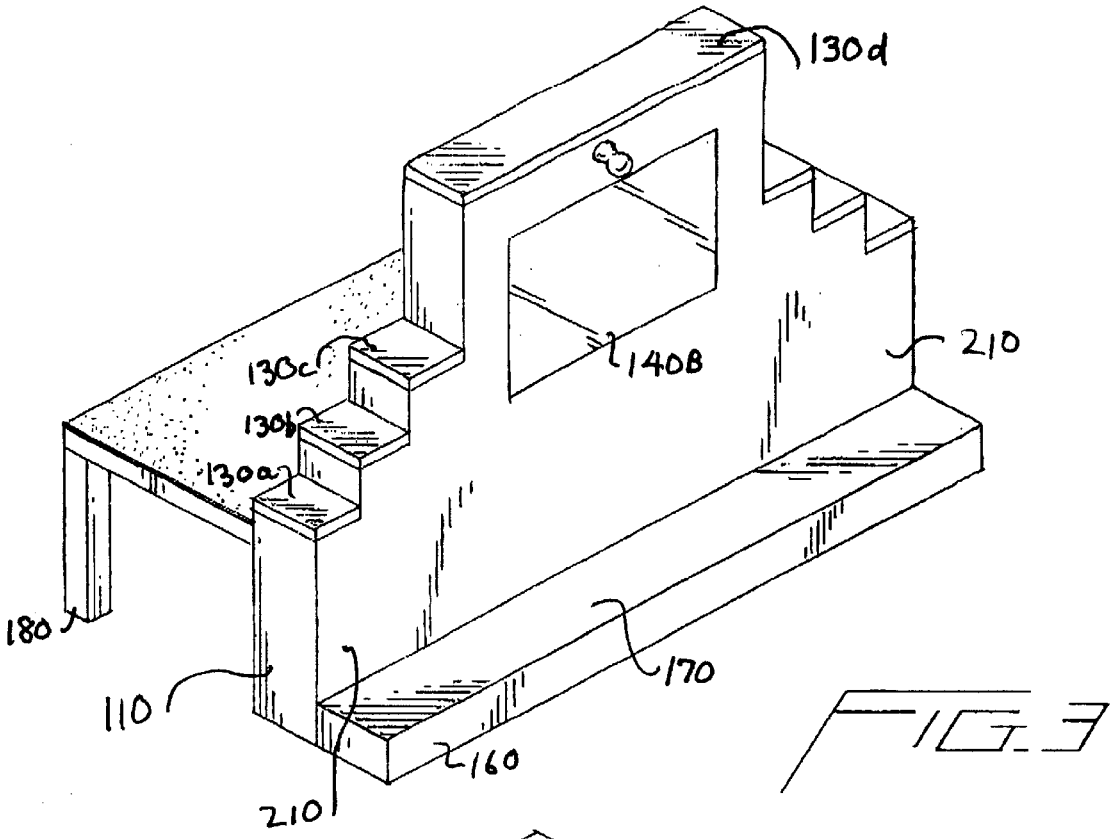
FIG. 3 is an isometric rear-view illustration of the stretching center.

An illustration in FIG. 1 shows a front-view of the stretcher bench. A reclined plane 100 may be disposed forward of a wall 110. The reclined plane 100 may preferably be cushioned with a hydrophobic (i.e., water-resistant) elastomeric cover. The wall 110 may include a top ridge 120 with multiple levels, preferably three levels 130*a*, 130*b*, 130*c* having differing heights on opposites sides of a central uppermost ridge 130*d*. The different levels preferably differ in elevation above the ground, for example by 5 inches, to accommodate golfers of varying heights wherein each level is used for both stretching quadriceps and stretching hamstrings. Alternatively, for some users, lower level 130*a* or intermediate level 130*b* may be used for stretching quadriceps, while intermediate level 130*b* or upper level 130*c* may be used for stretching hamstrings. Referring also to FIG. 3, the handle 135, preferably formed of brass, is provided centered on the rear surface 210 of the wall 110, below upper level 130*d*, as a balancing handhold. In alternative embodiments, as noted above, the posts, or rails, with or without handles, would preferably be provided at opposite ends of the wall 110 in place of or in addition to the handle 135, or the uppermost level 130*d* may be arch-shaped to provide the same handhold function. Tastefully arranged sign 140A, whether textual, graphical or both, may be displayed on the obverse surface 150 of the wall 110 for instructing passing golfers on the proper use of the golf stretching center. This or a similar sign 140B on the rear surface 210 may serve as a reminder to golfers to respite for a moment of stretching, or for public service announcements and/or commercial advertising.

Figure 2:
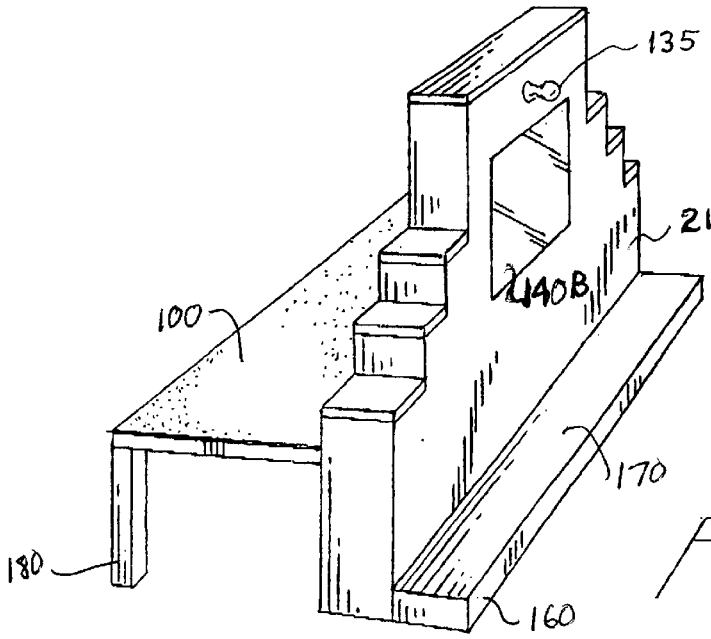
FIG. 2 is an isometric side-view illustration of a stretching center in accordance with the preferred embodiment.

An illustration in FIG. 2 shows a side-view of the stretching center. A curb platform 160 having a ledge 170 may be disposed along the bottom of the rear surface 210 of the wall 110. The reclined plane 100 may be raised from the ground at its front corners by a pair of stilts 180.

In the preferred embodiment, the dimensions may be as follows: the stilts 180 from ground to bottom of reclined plane 100 are about 18 inches tall; the length and width of reclined plane 100 are about 60 inches and 32 inches, respectively. The length of the wall 110 corresponding to the length of the reclined plane 100; the heights on ridge 120 of the levels 130*a*, 130*b* and 130*c* are respectively about at 20 inches, 25 inches and 30 inches above the ground, the lengths of levels 130*a*, 130*b* and 130*c* are each about 5 inches; the thickness of the wall along the ridge 120 is about 6 inches; the height of uppermost level 130*d* is about 45 inches and the height of the curb platform 160 is about 4 inches.

Figure 4:
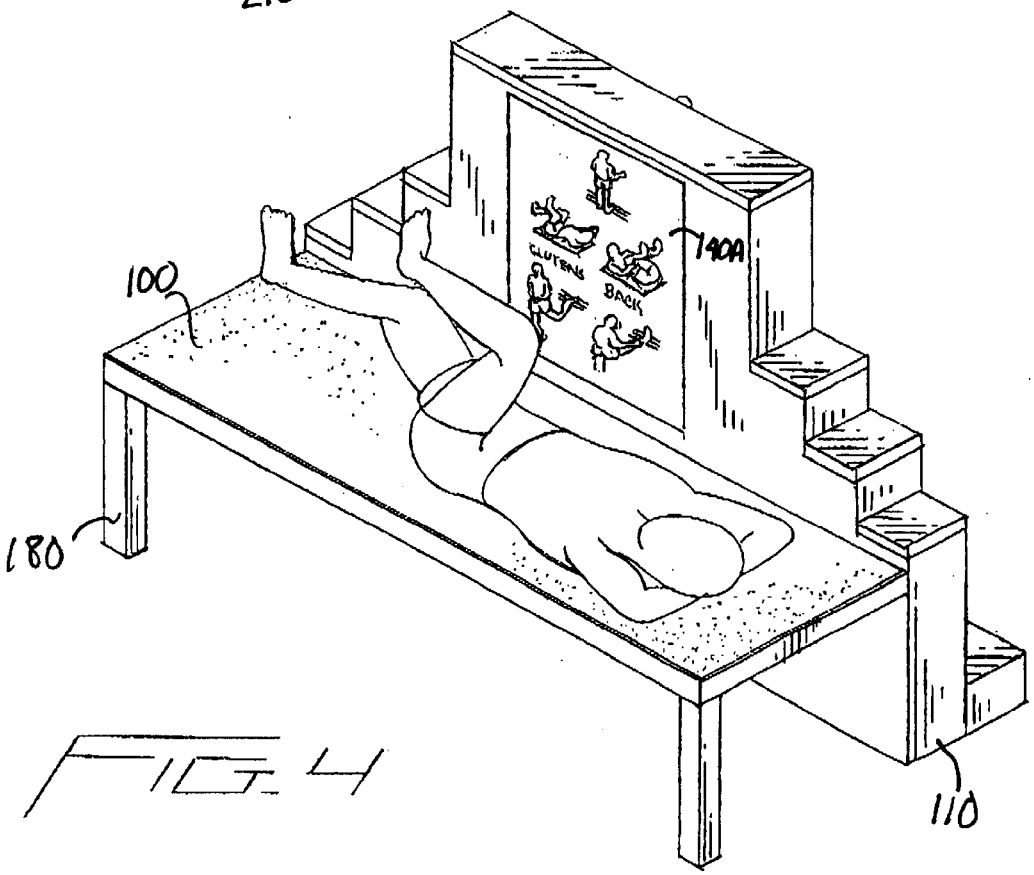
FIG. 4 is an isometric front-view illustration of the stretching center while used for stretching gluteus in accordance with the invention.
Figure 5:
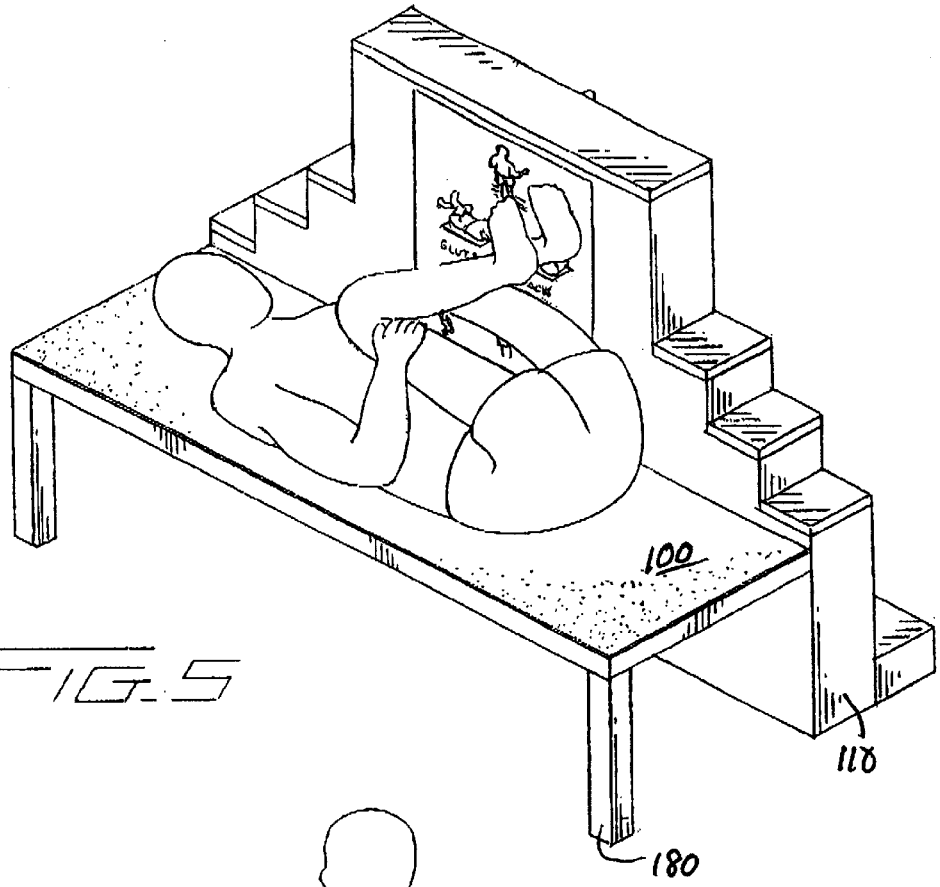
FIG. 5 is an isometric front-view illustration of a stretching center while used for stretching the lower back in accordance with the invention.

Proper techniques for performing stretching exercises with the aid of the stretching center are now described with reference to FIGS. 4–8. The reclined plane 100 is shown in FIGS. 4 and 5 being used for stretching the gluteus and the lower back. FIG. 4 illustrates a man in supine position with his back on the reclined plane 100, his right side against the obverse surface 150 of wall 110, and his left ankle positioned forward of and against the right knee. The left glutens stretch as the right leg pulls towards the chest. The leg positions may then be switched. FIG. 5 illustrates a man in supine position on the reclined plane 100 with his left side against the obverse surface 150, but with both knees pulled towards the chest, thereby stretching the lower back muscles.

Figure 6:
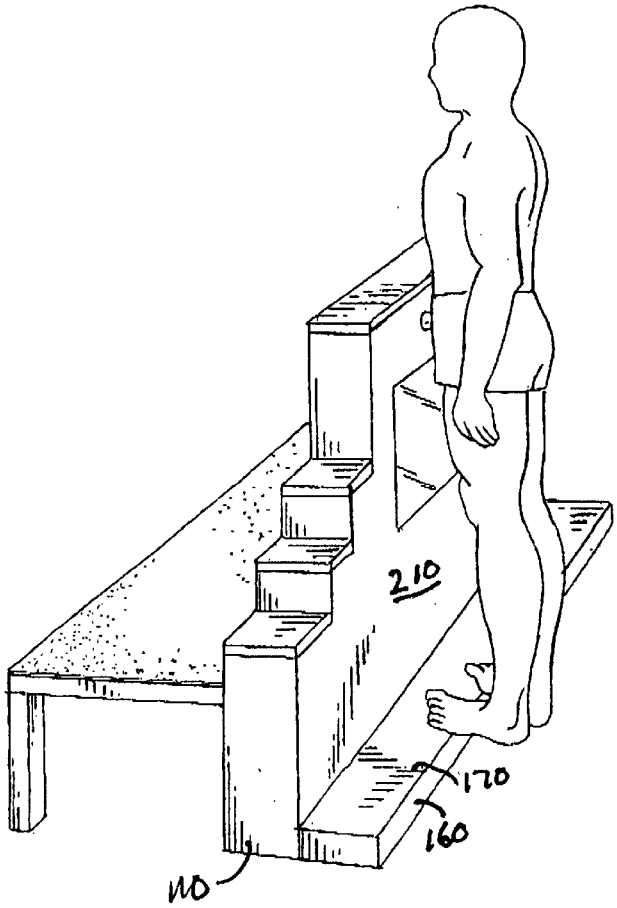
FIG. 6 is an isometric side-view illustration of the stretcher bench in use for stretching the calves in accordance the invention.

The curb platform 160 is shown in FIG. 6 being used for stretching the calves. A person stands facing the reverse surface 210 of the wall 110, with the balls of the feet supporting the body's cantilevered weight on the curb platform 160 and the heels suspended beyond the ledge 170. The resulting deflection of the heels downward as the person maintains balance while supporting his or her weight on the balls produces tension in the calves, enabling a stretch of these muscles.

Figure 7:
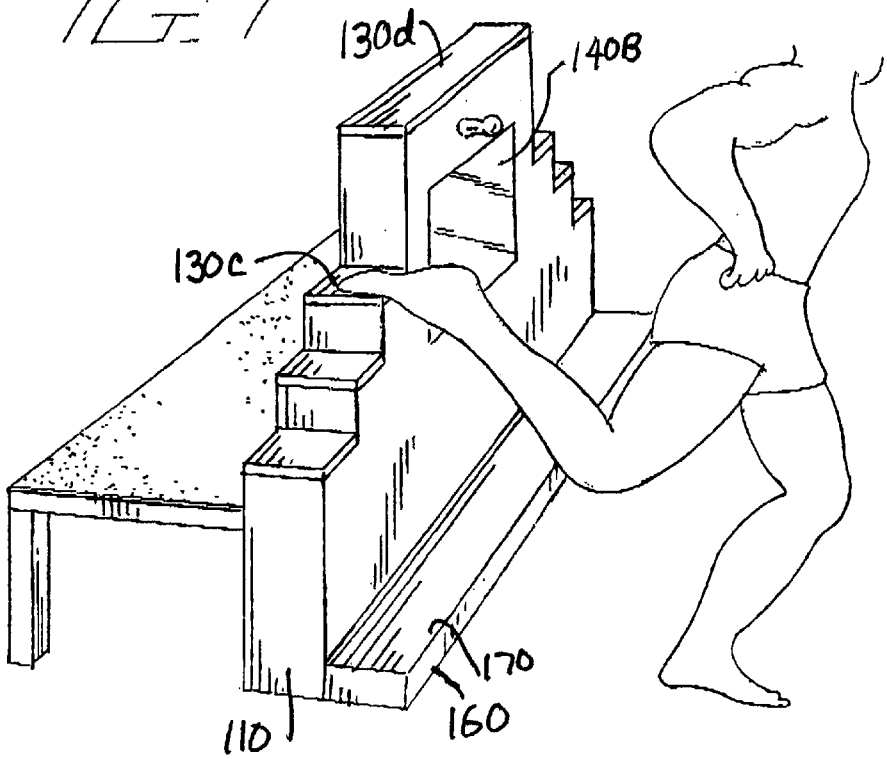
FIG. 7 is an isometric side-view illustration of a stretching center in use for stretching quadriceps in accordance with the invention.

The wall 110 is shown in FIG. 7 being used for stretching the quadriceps. A person stands on his or her left leg facing away from the reverse surface 210 of the wall 110 and the right foot arch supported by the upper level 130*c* of top ridge 120. The right quadricep muscles stretch as the left knee bends forward. Following a stretch in this position, the legs may be switched.

Figure 8:
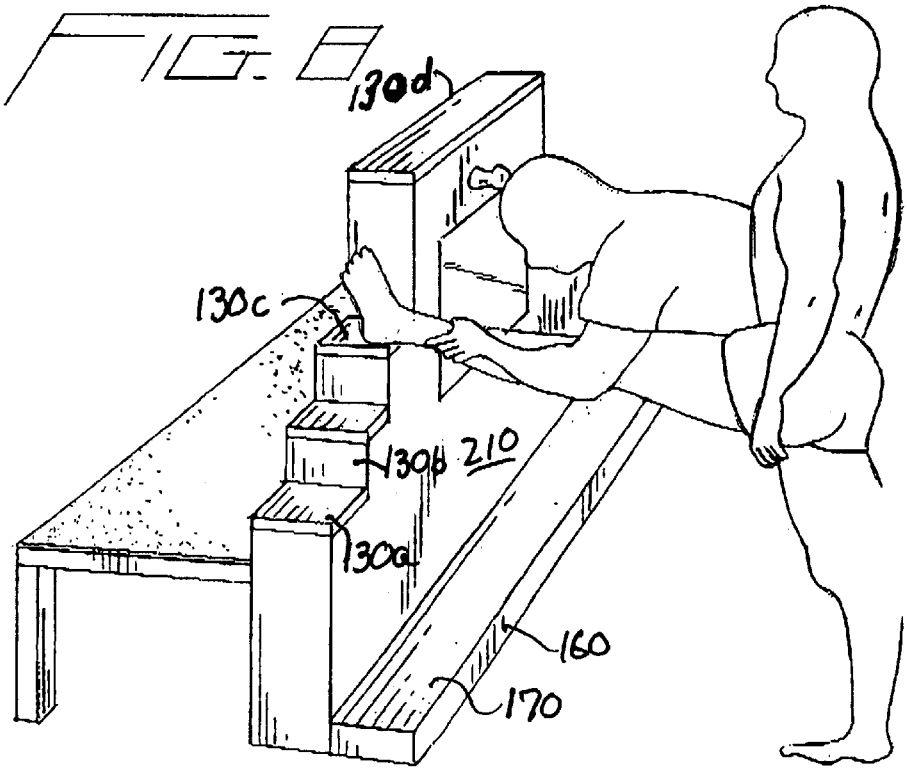
FIG. 8 is an isometric side-view illustration of a stretching center in use for stretching hamstrings in accordance with the invention.

The wall 110 is shown in FIG. 8 being used for stretching the hamstrings. A person stands on his or her right foot on the ground behind the person's center of gravity, while facing towards the reverse surface 210 of the wall 110. Supporting the left ankle on an upper level 130*c* of top ridge 120, the person may alternately stand erect or arch the back to bend forward, grabbing the left ankle. These postures impose tension in the left hamstrings, thereby causing them to stretch. Following this position, the legs may be switched.

While the structure and proper use of preferred embodiment has been shown and described, and further embodiments have also been described, applications of this invention, it would be apparent to those skilled in the art having the benefit of this disclosure that many more modifications not described or illustrated herein, are possible without departing from the inventive concepts disclosed herein. The invention, therefore, is not to be restricted except in the spirit of the appended claims.

What is claimed is:

1. A stretching apparatus comprising:

a wall having a top ridge, an obverse surface, and a reverse surface between a pair of vertical ends, wherein said wall is adapted for supporting a human foot resting on said top ridge;

a reclined plane along said obverse surface, below said top ridge, said reclined plane capable of supporting a human body in a supine position; and a curb platform extending along a lower edge of the apparatus, said curb platform having a ledge below said reclined plane for supporting a human body standing thereon.

2. The stretching apparatus of claim 1, wherein said top ridge has at least one horizontal portion adjacent each of the vertical opposite ends of the wall, further comprising a balancing handhold at the wall for providing balancing support to persons performing stretching exercises on said wall or said curb platform, wherein said balancing handhold includes an arched portion of the top ridge extending higher than the horizontal portions.

3. The stretching apparatus of claim 1, wherein said top ridge has at least one horizontal portion adjacent each of the vertical opposite ends of the wall, further comprising a balancing handhole at the wall for providing balancing support to persons performing stretching exercises on said wall or said platform, wherein said balancing handhold includes a handle mounted on the reverse surface of the wall.

4. The stretching apparatus of claim 1, further comprising a plurality of stilts disposed under said reclined plane to elevate said reclined plane above the ground a distance substantially greater than a thickness of said reclined plane so as to leave an open space extending from the ground to said reclined plane.

5. The stretching apparatus of claim 1, wherein the curb platform is disposed adjacent to said reverse surface.

6. The stretching apparatus of claim 1, further comprising at least one sign on said wall, disposed on one or both of said obverse surface and said reverse surface, instructing use of the apparatus to stretch the calves, gluteus, back, 7. A stretching apparatus comprising:

a wall having a top ridge, an obverse surface, and a reverse surface between a pair of vertical ends, wherein said top ridge has a plurality of horizontal levels, said wall capable of supporting a human foot disposed against any one of said horizontal levels;

a reclined plane abutting said obverse surface, below said top ridge, wherein said reclined plane is adapted for supporting a human body in a supine position; and a curb platform extending along a lower edge of the apparatus, said curb platform having a ledge below said reclined plane, wherein said curb platform is adapted for supporting a human body standing on said ledge, wherein at least the top ridge and the ledge have lengths measured in a first horizontal direction that are substantially longer than respective thickness thereof measured in a second horizontal direction perperdicular to the first horizontal direction.

8. The stretcher bench of claim 7, further comprising a sign on said wall, disposed on one or both of said obverse surface and said reverse surface instructing use of the apparatus to stretch the calves, back, and thigh.

9. The stretcher bench of claim 7, wherein said curb platform extends along a bottom edge of the reverse surface, and wherein said wall has first and second pluralities of the horizontal levels, the first plurality of horizontal levels adjacent one of the pair of vertical ends, the second plurality of horizontal levels adjacent the other of the pair of vertical ends, and a center wall portion between the first and second pluralities of horizontal levels, the top ledge having an uppermost level higher than the first and second pluralities of levels, and a handhold mounted to the reverse surface below the uppermost level midway between the first and second pluralities of horizontal levels, for providing balancing support to persons performing stretching exercises of said wall or said curb platform.

10. The stretching apparatus claim 7, wherein said top ridge has at least one horizontal portion adjacent each of the vertical opposite ends of the wall.

11. The stretching apparatus of claim 10, wherein the horizontal portions of the top ridge includes at least two horizontal portions of different heights, wherein the at least two horizontal portions of different heights includes horizontal portions having heights adapted for supporting a posterior surface of a foot of a leg for stretching hamstrings of the leg, and adapted for supporting a superior portion of the foot for stretching quadriceps of the leg.

12. The stretching apparatus of claim 7, wherein the curb platform extends at a lower edge of the apparatus, below or along the full length of the reverse surface, from one to the other of the pair of vertical ends, said curb platform having a ledge at a height below a height of said reclined plane.

13. The stretching apparatus of claim 12, wherein the height above the ground of the ledge of the curb platform is at level a adapted to receive the ball of a foot of a leg while the heel of the foot contacts the ground during a stretch of calf muscles of the leg.

14. The stretching apparatus of claim 7, wherein the height above the ground of the ledge of the curb platform at a level adapted to receive the ball of a foot of a leg while the heel of the foot contacts the ground during a stretch of the calf of the leg.

15. The stretcher bench of claim 7, wherein said wall has first and second pluralities of the horizontal levels, the first plurality of horizontal level adjacent one of the pair of vertical ends, the second plurality of horizontal levels adjacent the other of the pair of vertical ends, and a center wall portion between the first and second pluralities of horizontal levels.

16. The stretching apparatus of claim 1, wherein said top ridge has at least one horizontal portion adjacent each of the vertical opposite ends of the wall.

17. The stretching apparatus of claim 1, wherein the horizontal levels of the to ridge includes at least two horizontal levels of different heights, wherein the at least two horizontal levels of different heights includes horizontal levels having heights adapted for supporting a posterior surface of a foot of a leg for stretching hamstrings of the leg, and adapted for supporting a superior portion of the foot for stretching quadriceps of the leg.

18. The stretching apparatus of claim 1, wherein the curb platform extends at a lower edge of the apparatus, below or along the full length of the reverse surface, from one to the other of the pair of vertical ends, said curb platform having a ledge at a height below a height of said reclined plane.

19. The stretching apparatus of claim 12, wherein the height above the ground of the ledge of the curb platform is at level adapted to receive the ball of a foot of a leg while the heel of the foot contacts the ground during a stretch of calf muscles of the leg.

20. The stretching apparatus of claim 1, wherein the height above the ground of the ledge of the curb platform is at level adapted to receive the ball of a foot of a leg while the heel of the foot contacts the ground during a stretch of the calf of the leg.

21. The stretching apparatus of claim 1, wherein the wall has a thickness substantially less than a width of the reclined plane measured in a direction normal to the obverse surface of the wall.

22. The stretching apparatus of claim 1, wherein the curb platform has depth measured in a direction normal to the reverse surface of the wall substantially less than a width of the reclined plane measured in a direction normal to the obverse surface of the wall.

23. The stretching apparatus of claim 1, wherein said wall, said reclined plane; and said curb platform form a unitary, substantially rigid body with no moving parts.

24. A stretching apparatus, comprising:

a wall having a top ridge, an obverse surface, and a reverse surface between a pair of vertical ends, wherein said wall Is adapted for supporting a the foot of a person's leg, resting on said top ridge, while the person's body is supported by the person's other leg in contact with the ground;

a reclined plane along said obverse surface, below said top ridge, said reclined plane adapted for supporting a human body in a supine position; and a curb platform extending along a lower edge of the apparatus, said curb platform having a ledge below said reclined plane for supporting the sole of a foot of a leg of the person while the person stretches the calf of the leg.

* * * * *